US009728858B2

(12) United States Patent
Zhu et al.

(10) Patent No.: US 9,728,858 B2
(45) Date of Patent: Aug. 8, 2017

(54) ELECTRONIC DEVICES WITH HYBRID ANTENNAS

(71) Applicant: Apple Inc., Cupertino, CA (US)

(72) Inventors: Jiang Zhu, Sunnyvale, CA (US); Rodney A. Gomez Angulo, Sunnyvale, CA (US); Qingxiang Li, Mountain View, CA (US); Robert W. Schlub, Cupertino, CA (US); Hongfei Hu, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 239 days.

(21) Appl. No.: 14/260,800

(22) Filed: Apr. 24, 2014

(65) Prior Publication Data

US 2015/0311594 A1 Oct. 29, 2015

(51) Int. Cl.
*H01Q 1/24* (2006.01)
*H01Q 13/10* (2006.01)
(Continued)

(52) U.S. Cl.
CPC ..... *H01Q 13/10* (2013.01); *H01Q 1/2266* (2013.01); *H01Q 1/243* (2013.01); *H01Q 9/0421* (2013.01); *H01Q 21/28* (2013.01)

(58) Field of Classification Search
CPC ..... H01Q 9/0421; H01Q 1/38; H01Q 13/10; H01Q 1/241–1/244; H01Q 13/085; H01Q 13/16; H01Q 13/18
(Continued)

(56) References Cited

U.S. PATENT DOCUMENTS 4,016,490 A 4/1977 Weckenmann et al.
4,614,937 A 9/1986 Poujois
(Continued)

FOREIGN PATENT DOCUMENTS

CN 1343380 4/2002
CN 1543010 11/2004
(Continued)

OTHER PUBLICATIONS

The ARRL Antenna Book, Published by The American Radio Relay League.*
(Continued)

*Primary Examiner* — Hoang Nguyen
*Assistant Examiner* — Awat Salih
(74) *Attorney, Agent, or Firm* — Treyz Law Group, P.C.; G Victor Treyz; Tianyi He

(57) ABSTRACT

An electronic device may be provided with hybrid planar inverted-F slot antennas and indirectly fed slot antennas. A hybrid antenna may be used to form a dual band wireless local area network antenna. An indirectly fed slot antenna may be use to form a cellular telephone antenna. Antenna slots may be formed in a metal electronic device housing wall. The housing wall may have a planar rear portion and sidewall portions that extend upwards from the planar rear portion. The slots may have one or more bends. A hybrid antenna may have a slot antenna portion and a planar inverted-F antenna portion. The planar inverted-F antenna portion may have a metal resonating element patch that is supported by a support structure. The support structure may be a plastic speaker box containing a speaker driver that is not overlapped by the metal resonating element patch.

20 Claims, 14 Drawing Sheets

(51) Int. Cl.
*H01Q 1/22* (2006.01)
*H01Q 9/04* (2006.01)
*H01Q 21/28* (2006.01)

(58) Field of Classification Search
USPC ..... 343/702, 725, 893
See application file for complete search history.

(56) References Cited

U.S. PATENT DOCUMENTS 5,337,353 A 8/1994 Boie et al.
5,410,497 A 4/1995 Viletto
5,463,406 A 10/1995 Vannatta et al.
5,650,597 A 7/1997 Redmayne
5,826,458 A 10/1998 Little
5,854,972 A 12/1998 Pennock et al.
5,864,316 A 1/1999 Bradley et al.
5,905,467 A 5/1999 Narayanaswamy et al.
5,956,626 A 9/1999 Kaschke et al.
6,181,281 B1 1/2001 Desclos
6,301,489 B1 10/2001 Winstead et al.
6,329,958 B1 12/2001 McLean et al.
6,380,899 B1 4/2002 Madsen et al.
6,380,903 B1 * 4/2002 Hayes ..... H01Q 1/243 343/700 MS
6,408,193 B1 6/2002 Katagishi et al.
6,445,906 B1 9/2002 Nguyen et al.
6,448,932 B1 * 9/2002 Stoiljkovic ..... H01Q 1/243 343/700 MS
6,456,856 B1 9/2002 Werling et al.
6,480,162 B2 11/2002 Sabet
6,529,088 B2 3/2003 Lafleur et al.
6,590,539 B2 7/2003 Shinichi
6,611,227 B1 8/2003 Nebiyeloul-Kifle et al.
6,657,595 B1 12/2003 Phillips et al.
6,678,532 B1 1/2004 Mizoguchi
6,741,214 B1 5/2004 Kadambi et al.
6,788,266 B2 9/2004 St. Hillaire
6,879,293 B2 4/2005 Sato
6,975,276 B2 12/2005 Brown
6,978,121 B1 12/2005 Lane et al.
6,985,108 B2 * 1/2006 Mikkola ..... H01Q 1/243 343/700 MS
6,985,113 B2 1/2006 Nishimura et al.
7,016,686 B2 3/2006 Spaling
7,039,435 B2 5/2006 McDowell et al.
7,050,010 B2 5/2006 Wang et al.
7,109,945 B2 9/2006 Mori
7,113,087 B1 9/2006 Casebolt
7,146,139 B2 12/2006 Nevermann
7,221,092 B2 5/2007 Anzai et al.
7,356,361 B1 4/2008 Hawkins et al.
7,388,550 B2 6/2008 McLean
7,499,722 B2 3/2009 McDowell et al.
7,502,221 B2 3/2009 Fuller et al.
7,522,846 B1 4/2009 Lewis et al.
7,538,760 B2 5/2009 Hotelling et al.
7,551,142 B1 6/2009 Zhang et al.
7,557,760 B2 7/2009 Chang et al.
7,595,788 B2 9/2009 Son
7,633,076 B2 12/2009 Huppi et al.
7,663,612 B2 2/2010 Bladt
7,705,787 B2 * 4/2010 Ponce De Leon ..... H01Q 1/52 343/700 MS
7,826,875 B2 11/2010 Karaoguz et al.
7,834,813 B2 11/2010 Caimi et al.
7,864,123 B2 * 1/2011 Hill ..... H01Q 1/243 343/702
7,876,274 B2 1/2011 Hobson et al.
7,999,748 B2 8/2011 Ligtenberg et al.
8,059,039 B2 11/2011 Ayala Vazquez et al.
8,059,040 B2 11/2011 Ayala Vazquez et al.
8,115,753 B2 2/2012 Newton
8,159,399 B2 4/2012 Dorsey et al.
8,228,198 B2 7/2012 McAllister
8,238,971 B2 8/2012 Terlizzi
8,255,009 B2 8/2012 Sorensen et al.
8,270,914 B2 9/2012 Pascolini et al.
8,319,692 B2 11/2012 Chiang et al.
8,325,094 B2 12/2012 Ayala Vazquez et al.
8,326,221 B2 12/2012 Dorsey et al.
8,347,014 B2 1/2013 Schubert et al.
8,368,602 B2 2/2013 Hill
8,417,296 B2 4/2013 Caballero et al.
8,432,322 B2 4/2013 Amm et al.
8,436,816 B2 5/2013 Leung et al.
8,466,839 B2 6/2013 Schlub et al.
8,497,806 B2 * 7/2013 Lai ..... H01Q 1/243 343/700 MS
8,517,383 B2 8/2013 Wallace et al.
8,525,734 B2 * 9/2013 Krogerus ..... H01Q 1/243 343/702
8,531,337 B2 9/2013 Soler Castany et al.
8,577,289 B2 11/2013 Schlub et al.
8,610,629 B2 12/2013 Pascolini et al.
8,638,266 B2 1/2014 Liu
8,638,549 B2 1/2014 Garelli et al.
8,648,752 B2 2/2014 Ramachandran et al.
8,749,523 B2 6/2014 Pance et al.
8,781,420 B2 7/2014 Schlub et al.
8,798,554 B2 8/2014 Darnell et al.
8,836,587 B2 9/2014 Darnell et al.
8,872,706 B2 10/2014 Caballero et al.
8,896,488 B2 11/2014 Ayala Vazquez et al.
8,947,302 B2 2/2015 Caballero et al.
8,947,305 B2 2/2015 Amm et al.
8,952,860 B2 2/2015 Li et al.
8,963,782 B2 2/2015 Ayala Vazquez et al.
8,963,783 B2 * 2/2015 Vin ..... H01Q 1/22 343/700 MS
9,024,823 B2 5/2015 Bevelacqua
9,035,833 B2 * 5/2015 Zhang ..... H01Q 1/243 343/702
2002/0015024 A1 2/2002 Westerman et al.
2002/0027474 A1 3/2002 Bonds
2002/0060645 A1 5/2002 Shinichi
2002/0094789 A1 7/2002 Harano
2002/0123309 A1 9/2002 Collier et al.
2003/0062907 A1 4/2003 Nevermann
2003/0186728 A1 10/2003 Manjo
2003/0193438 A1 * 10/2003 Yoon ..... H01Q 1/243 343/702
2003/0197597 A1 10/2003 Bahl et al.
2003/0210203 A1 11/2003 Phillips et al.
2003/0218993 A1 11/2003 Moon et al.
2004/0051670 A1 3/2004 Sato
2004/0080457 A1 * 4/2004 Guo ..... H01Q 1/243 343/700 MS
2004/0104853 A1 6/2004 Chen
2004/0176083 A1 9/2004 Shiao et al.
2004/0189542 A1 9/2004 Mori
2004/0222926 A1 11/2004 Kontogeorgakis et al.
2004/0239575 A1 12/2004 Shoji
2005/0146475 A1 7/2005 Bettner
2005/0168384 A1 8/2005 Wang et al.
2005/0245204 A1 11/2005 Vance
2005/0264466 A1 12/2005 Hibino et al.
2006/0001576 A1 1/2006 Contopanagos
2006/0152497 A1 7/2006 Rekimoto
2006/0161871 A1 7/2006 Hotelling et al.
2006/0232468 A1 10/2006 Parker et al.
2006/0244663 A1 11/2006 Fleck et al.
2006/0248363 A1 11/2006 Chen et al.
2006/0250310 A1 * 11/2006 Yeh ..... H01Q 1/243 343/702
2006/0274493 A1 12/2006 Richardson et al.
2006/0278444 A1 12/2006 Binstead
2007/0120740 A1 * 5/2007 Iellici ..... H01Q 1/243 343/700 MS
2007/0126711 A1 6/2007 Oshita
2007/0188375 A1 8/2007 Richards et al.
2007/0239921 A1 10/2007 Toorians et al.
2008/0165063 A1 7/2008 Schlub et al.

(56) References Cited

U.S. PATENT DOCUMENTS

2008/0246735 A1 10/2008 Reynolds et al.
2008/0248837 A1 10/2008 Kunkel
2008/0297487 A1 12/2008 Hotelling et al.
2008/0309836 A1 12/2008 Sakama et al.
2008/0316116 A1* 12/2008 Hobson ..... H01Q 1/243 343/702
2008/0316120 A1 12/2008 Hirota et al.
2009/0000023 A1 1/2009 Wegelin et al.
2009/0040109 A1* 2/2009 Iguchi ..... H01Q 1/2283 343/700 MS
2009/0096683 A1 4/2009 Rosenblatt et al.
2009/0128435 A1 5/2009 Jeng
2009/0153407 A1 6/2009 Zhang et al.
2009/0153410 A1 6/2009 Chiang
2009/0174611 A1 7/2009 Schlub et al.
2009/0256757 A1 10/2009 Chiang
2009/0256758 A1 10/2009 Schlub et al.
2009/0295648 A1 12/2009 Dorsey et al.
2010/0062728 A1 3/2010 Black et al.
2010/0079351 A1* 4/2010 Huang ..... H01Q 1/48 343/846
2010/0081374 A1 4/2010 Moosavi
2010/0109971 A2 5/2010 Gummalla et al.
2010/0167672 A1 7/2010 Ahn et al.
2010/0182203 A1 7/2010 See
2010/0194642 A1* 8/2010 Rao ..... H01Q 1/38 343/700 MS
2010/0238072 A1 9/2010 Ayatollahi et al.
2010/0253651 A1 10/2010 Day
2011/0012793 A1 1/2011 Amm et al.
2011/0012794 A1 1/2011 Schlub et al.
2011/0043408 A1* 2/2011 Shi ..... H01Q 9/0421 343/700 MS
2011/0045789 A1 2/2011 Sinton et al.
2011/0050509 A1 3/2011 Ayala Vazquez et al.
2011/0212746 A1 9/2011 Sarkar et al.
2011/0241949 A1 10/2011 Nickel et al.
2011/0260924 A1 10/2011 Roy
2011/0260939 A1 10/2011 Korva et al.
2011/0300907 A1 12/2011 Hill et al.
2012/0009983 A1 1/2012 Mow et al.
2012/0068893 A1 3/2012 Guterman et al.
2012/0092298 A1 4/2012 Koottungal
2012/0105295 A1* 5/2012 Lin ..... H01Q 1/243 343/841
2012/0112969 A1 5/2012 Caballero et al.
2012/0112970 A1 5/2012 Caballero et al.
2012/0176279 A1 7/2012 Merz et al.
2012/0214412 A1 8/2012 Schlub et al.
2012/0223865 A1 9/2012 Li et al.
2012/0223866 A1 9/2012 Ayala Vazquez et al.
2012/0229360 A1 9/2012 Jagielski et al.
2012/0299785 A1 11/2012 Bevelacqua
2013/0044036 A1* 2/2013 Kuonanoja ..... H01Q 1/243 343/810
2013/0050032 A1* 2/2013 Shiu ..... H01Q 1/24 343/702
2013/0050038 A1 2/2013 Eom et al.
2013/0082884 A1 4/2013 Gummalla
2013/0106660 A1 5/2013 Kang
2013/0115884 A1 5/2013 Zhang
2013/0154900 A1 6/2013 Tsai et al.
2013/0169490 A1 7/2013 Pascolini et al.
2013/0201067 A1 8/2013 Hu et al.
2013/0203364 A1 8/2013 Darnell et al.
2013/0234910 A1 9/2013 Oh et al.
2013/0257659 A1 10/2013 Darnell et al.
2013/0285857 A1 10/2013 Schultz
2013/0293425 A1 11/2013 Zhu et al.
2013/0321216 A1 12/2013 Jervis et al.
2013/0328730 A1 12/2013 Guterman et al.
2013/0333496 A1 12/2013 Boutouil et al.
2013/0342411 A1 12/2013 Jung
2014/0009352 A1 1/2014 Sung
2014/0086441 A1* 3/2014 Zhu ..... H01Q 1/243 381/332
2014/0184450 A1 7/2014 Koo
2014/0266941 A1* 9/2014 Vazquez ..... H01Q 13/103 343/746
2014/0292598 A1 10/2014 Bevelacqua et al.
2014/0333495 A1 11/2014 Vazquez et al.
2014/0340265 A1 11/2014 Vazquez et al.
2014/0375509 A1 12/2014 Vance et al.
2015/0180123 A1 6/2015 Tatomirescu
2015/0236426 A1* 8/2015 Zhu ..... H01Q 13/10 343/702
2015/0270618 A1 9/2015 Zhu et al.
2015/0270619 A1* 9/2015 Zhu ..... G01V 3/00 343/702

FOREIGN PATENT DOCUMENTS

CN 101330162 12/2008
DE 102005035935 2/2007
EP 0086135 8/1983
EP 0 564 164 10/1993
EP 1298809 4/2003
EP 1324425 7/2003
EP 1361623 11/2003
EP 1 469 550 10/2004
EP 1 524 774 4/2005
EP 1564896 8/2005
EP 1593988 11/2005
GB 2 380 359 4/2003
JP 05-128828 5/1993
JP 2003179670 6/2003
JP 2003209483 7/2003
JP 2003330618 11/2003
JP 2004005516 1/2004
JP 200667061 3/2006
JP 2007-170995 7/2007
JP 2008046070 2/2008
JP 2009032570 2/2009
WO 0131733 5/2001
WO 02/05443 1/2002
WO 2004010528 1/2004
WO 2004112187 12/2004
WO 2005112280 11/2005
WO 2006060232 6/2006
WO 2007124333 1/2007
WO 2007116790 10/2007
WO 2008/078142 7/2008
WO 2009022387 2/2009
WO 2009149023 12/2009
WO 2011022067 2/2011
WO 2013123109 A1 8/2013
WO 2013165419 11/2013

OTHER PUBLICATIONS

Th ARRL Antenna Book, The American Radio Relay League.*
The ARRL Antenna Book.*
Yarga et al., U.S. Appl. No. 13/790,549, filed Mar. 8, 2013.
Jiang et al., U.S. Appl. No. 13/864,968, filed Apr. 17, 2013.
Schlub et al., U.S. Appl. No. 13/420,278, filed Mar. 14, 2012.
Zhu et al., U.S. Appl. No. 13/402,831, filed Feb. 22, 2012.
Ayala Vazquez et al., U.S. Appl. No. 13/895,194, filed May 15, 2013.
Bevelacqua et al., U.S. Appl. No. 13/860,396, filed Apr. 10, 2013.
Vazquez et al., U.S. Appl. No. 13/889,987, filed May 8, 2013.
Hu et al., U.S. Appl. No. 13/890,013, filed May 8, 2013.
Bevelacqua et al., U.S. Appl. No. 13/851,471, filed Mar. 27, 2013.
Jin et al., U.S. Appl. No. 13/846,471, filed Mar. 18, 2013.
Ouyang et al., U.S. Appl. No. 13/846,459, filed Mar. 18, 2013.
Zhou et al., U.S. Appl. No. 13/846,481, filed Mar. 18, 2013.
Schlub et al., U.S. Appl. No. 13/865,578, filed Apr. 18, 2013.
Caballero et al., U.S. Appl. No. 13/886,157, filed May 2, 2013.
Yarga et al., U.S. Appl. No. 13/855,568, filed Apr. 2, 2013.
Zhu et al., U.S. Appl. No. 14/180,866, filed Feb. 14, 2014.
Jadhav et al., U.S. Appl. No. 14/201,620, filed Mar. 7, 2014.

(56) References Cited

OTHER PUBLICATIONS

Guterman et al., U.S. Appl. No. 14/202,860, filed Mar. 10, 2014.
Pascolini et al., U.S. Appl. No. 14/710,377, filed May 12, 2015.
Myllmaki et al., "Capacitive recognition of the user's hand grip position in mobile handsets", Progress in Electromagnetics Research B, vol. 22, 2010, pp. 203-220.
"CapTouch Programmable Controller for Single-Electrode Capacitance Sensors", AD7147 Data Sheet Rev. B, [online], Analog Devices, Inc., [retrieved on Dec. 7, 2009], <URL: http://www.analog.com/static/imported-files/data_sheets/AD7147.pdf>.
Liu et al., MEMS-Switched, Frequency-Tunable Hybrid Slot/PIFA Antenna; IEEE Antennas and Wireless Propagation Letters, vol. 8, 2009; p. 311-314.
Pance et al., U.S. Appl. No. 61/235,905, filed Aug. 21, 2009.
Azad et al., U.S. Appl. No. 15/066,419, filed Mar. 10, 2016.

* cited by examiner

ELECTRONIC DEVICES WITH HYBRID ANTENNAS

BACKGROUND

This relates generally to electronic devices and, more particularly, to electronic devices with antennas.

Electronic devices often include antennas. For example, cellular telephones, computers, and other devices often contain antennas for supporting wireless communications.

It can be challenging to form electronic device antenna structures with desired attributes. In some wireless devices, the presence of conductive housing structures can influence antenna performance. Antenna performance may not be satisfactory if the housing structures are not configured properly and interfere with antenna operation. Device size can also affect performance. It can be difficult to achieve desired performance levels in a compact device, particularly when the compact device has conductive housing structures.

It would therefore be desirable to be able to provide improved wireless circuitry for electronic devices such as electronic devices that include conductive housing structures.

SUMMARY

An electronic device may be provided with wireless circuitry. The wireless circuitry may include radio-frequency transceiver circuitry and one or more antennas. Antennas for the electronic device may be formed from hybrid planar inverted-F slot antenna structures and indirectly fed slot antennas.

A hybrid antenna may be used to form a dual band wireless local area network antenna. An indirectly fed slot antenna may be use to form a cellular telephone antenna. Arrays of multiple hybrid antennas may also be formed.

A hybrid antenna may have a slot antenna portion and a planar inverted-F antenna portion. The planar inverted-F antenna portion may have a metal resonating element patch that is supported by a support structure. The support structure may be a plastic speaker box containing a speaker driver that is not overlapped by the metal resonating element patch.

Antenna slots for the antennas in the electronic device may be formed in a metal electronic device housing wall. The housing wall may have a planar rear portion and sidewall portions that extend upwards from the planar rear portion. The slots may have one or more bends and may be filled with plastic. Slots may also be formed in metal traces on a printed circuit or other metal structures.

DETAILED DESCRIPTION

Electronic devices may be provided with antennas. The antennas may include slot antenna structures and/or other antenna structures such as inverted-F antenna structures (e.g., planar inverted-F antenna structures). Hybrid antennas and indirectly fed antennas may be formed. For example, a hybrid planar inverted-F slot antenna may be formed by incorporating both planar inverted-F antenna structures and slot antenna structures into an antenna. Slots for antennas can be formed in device structures such as electronic device housing structures. Illustrative electronic devices that have housings that accommodate slot antenna structures, hybrid antennas, and other wireless circuitry are shown in FIGS. 1, 2, 3, and 4.

Figure 1:
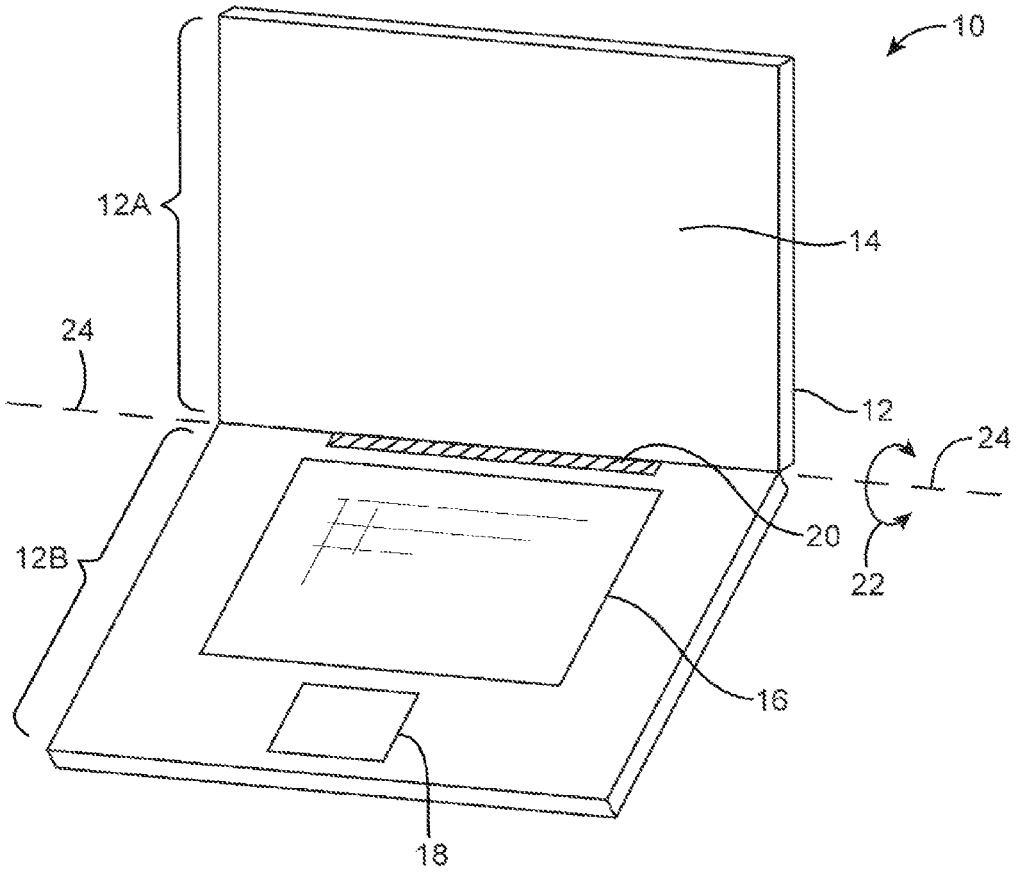
FIG. 1 is a perspective view of an illustrative electronic device such as a laptop computer in accordance with an embodiment.

Electronic device 10 of FIG. 1 has the shape of a laptop computer and has upper housing 12A and lower housing 12B with components such as keyboard 16 and touchpad 18. Device 10 has hinge structures 20 (sometimes referred to as a clutch barrel) to allow upper housing 12A to rotate in directions 22 about rotational axis 24 relative to lower housing 12B. Display 14 is mounted in housing 12A. Upper housing 12A, which may sometimes be referred to as a display housing or lid, is placed in a closed position by rotating upper housing 12A towards lower housing 12B about rotational axis 24.

Figure 2:
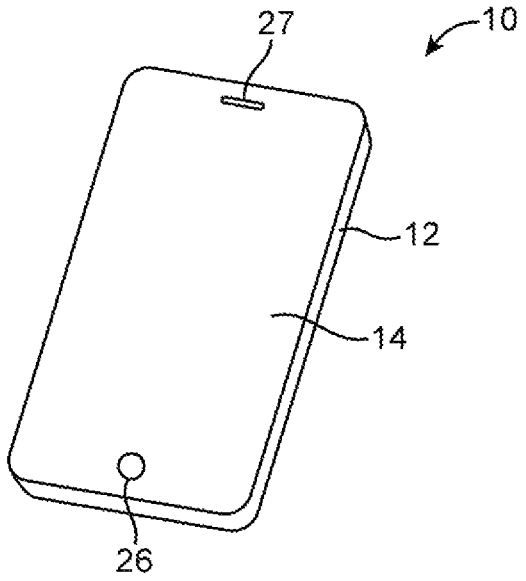
FIG. 2 is a perspective view of an illustrative electronic device such as a handheld electronic device in accordance with an embodiment.

FIG. 2 shows an illustrative configuration for electronic device 10 based on a handheld device such as a cellular telephone, music player, gaming device, navigation unit, or other compact device. In this type of configuration for device 10, device 10 has opposing front and rear surfaces. The rear surface of device 10 may be formed from a planar portion of housing 12. Display 14 forms the front surface of device 10. Display 14 may have an outermost layer that includes openings for components such as button 26 and speaker port 27.

Figure 3:
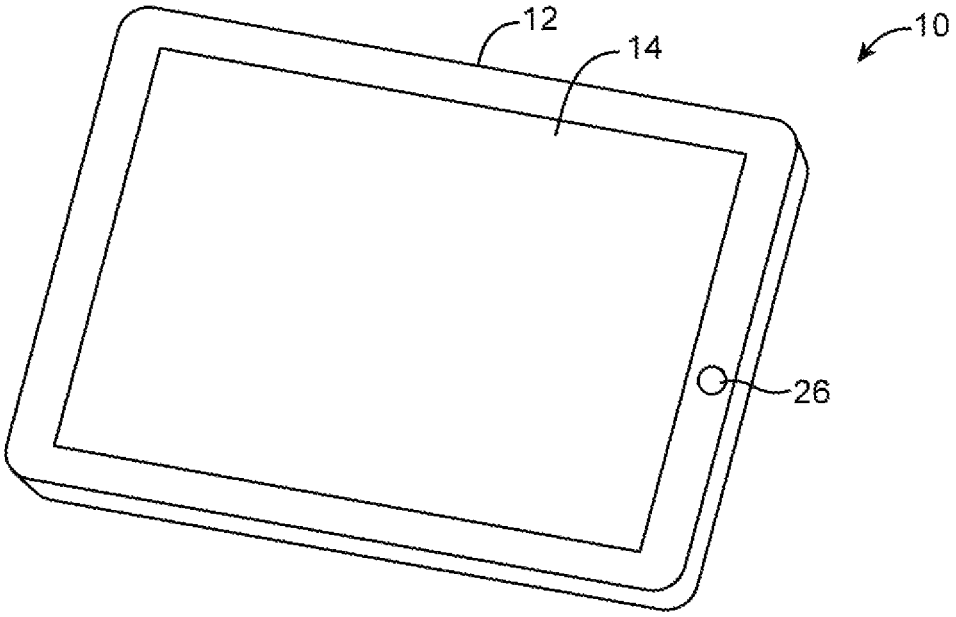
FIG. 3 is a perspective view of an illustrative electronic device such as a tablet computer in accordance with an embodiment.

In the example of FIG. 3, electronic device 10 is a tablet computer. In electronic device 10 of FIG. 3, device 10 has opposing planar front and rear surfaces. The rear surface of device 10 is formed from a planar rear wall portion of housing 12. Curved or planar sidewalls may run around the periphery of the planar rear wall and may extend vertically upwards. Display 14 is mounted on the front surface of device 10 in housing 12. As shown in FIG. 3, display 14 has an outermost layer with an opening to accommodate button 26.

Figure 4:
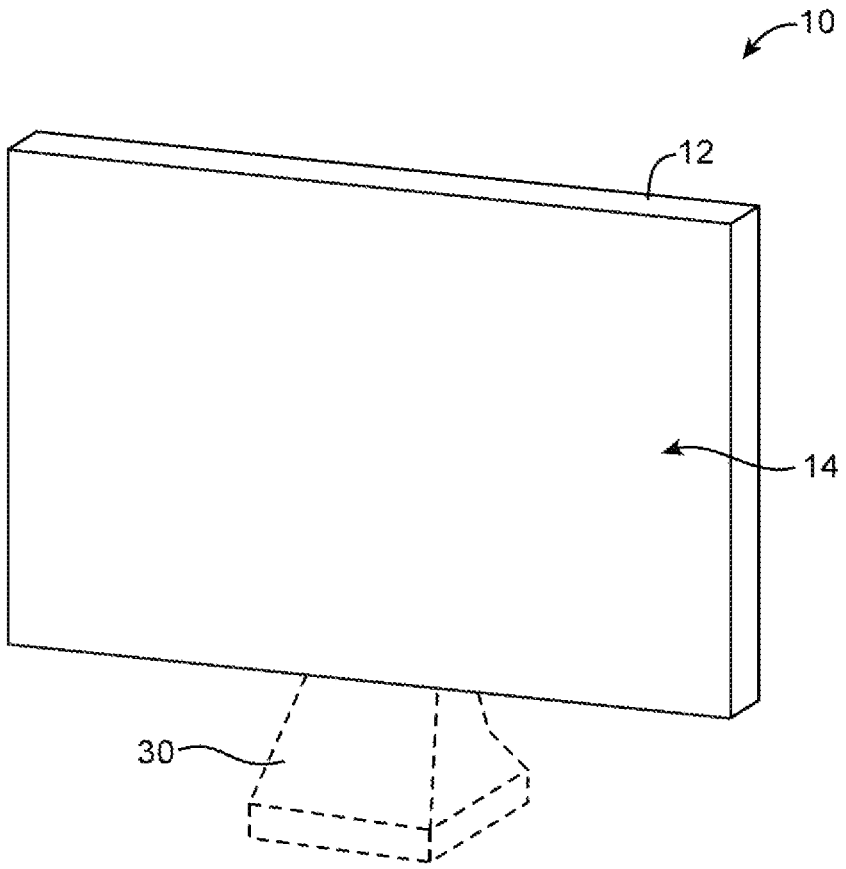
FIG. 4 is a perspective view of an illustrative electronic device such as a display for a computer or television in accordance with an embodiment.

FIG. 4 shows an illustrative configuration for electronic device 10 in which device 10 is a computer display, a computer that has an integrated computer display, or a television. Display 14 is mounted on a front face of device 10 in housing 12. With this type of arrangement, housing 12 for device 10 may be mounted on a wall or may have an optional structure such as support stand 30 to support device 10 on a flat surface such as a tabletop or desk.

An electronic device such as electronic device 10 of FIGS. 1, 2, 3, and 4, may, in general, be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. The examples of FIGS. 1, 2, 3, and 4 are merely illustrative.

Device 10 may include a display such as display 14. Display 14 may be mounted in housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies.

Display 14 may be protected using a display cover layer such as a layer of transparent glass or clear plastic. Openings may be formed in the display cover layer. For example, an opening may be formed in the display cover layer to accommodate a button, an opening may be formed in the display cover layer to accommodate a speaker port, etc.

Housing 12 may be formed from conductive materials and/or insulating materials. In configurations in which housing 12 is formed from plastic or other dielectric materials, antenna signals can pass through housing 12. Antennas in this type of configuration can be mounted behind a portion of housing 12. In configurations in which housing 12 is formed from a conductive material (e.g., metal), it may be desirable to provide one or more radio-transparent antenna windows in openings in the housing. As an example, a metal housing may have openings that are filled with plastic antenna windows. Antennas may be mounted behind the antenna windows and may transmit and/or receive antenna signals through the antenna windows.

Figure 5:
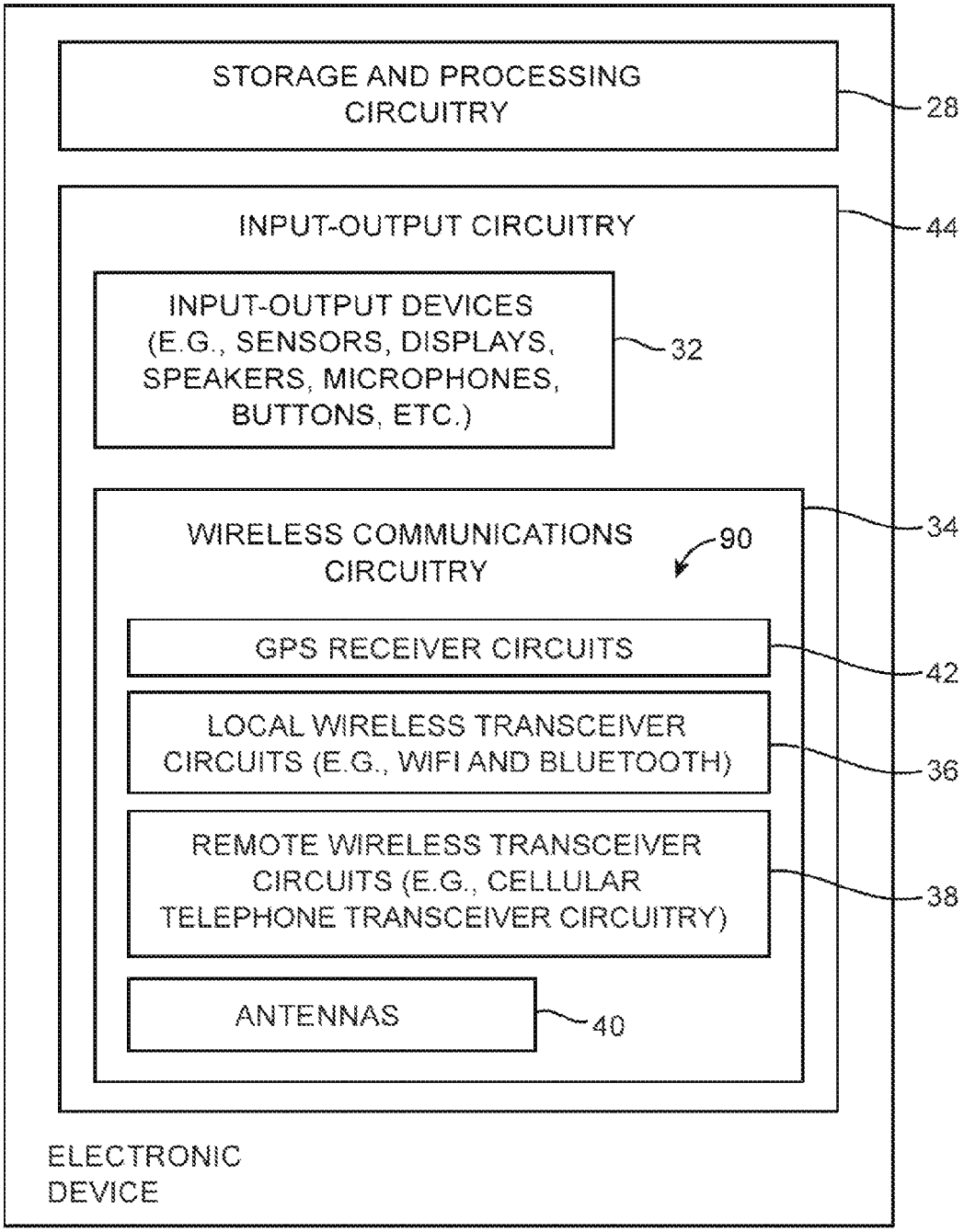
FIG. 5 is a schematic diagram of illustrative circuitry in an electronic device in accordance with an embodiment.

A schematic diagram showing illustrative components that may be used in device 10 is shown in FIG. 5. As shown in FIG. 5, device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, MIMO protocols, antenna diversity protocols, etc.

Input-output circuitry 44 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons, joysticks, click wheels, scrolling wheels, touch pads, key pads, keyboards, microphones, cameras, buttons, speakers, status indicators, light sources, audio jacks and other audio port components, digital data port devices, light sensors, motion sensors (accelerometers), capacitance sensors, proximity sensors, etc.

Input-output circuitry 44 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, and 42. Transceiver circuitry 36 may be wireless local area network transceiver circuitry that may handle 2.4 GHz and 5 GHz bands for WiFi® (IEEE 802.11) communications and that may handle the 2.4 GHz Bluetooth® communications band. Circuitry 34 may use cellular telephone transceiver circuitry 38 for handling wireless communications in frequency ranges such as a low communications band from 700 to 960 MHz, a midband from 1710 to 2170 MHz, and a high band from 2300 to 2700 MHz or other communications bands between 700 MHz and 2700 MHz or other suitable frequencies (as examples). Circuitry 38 may handle voice data and non-voice data. Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) circuitry, etc. Wireless communications circuitry 34 may include satellite navigation system circuitry such as global positioning system (GPS) receiver circuitry 42 for receiving GPS signals at 1575 MHz or for handling other satellite positioning data. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Figure 6:
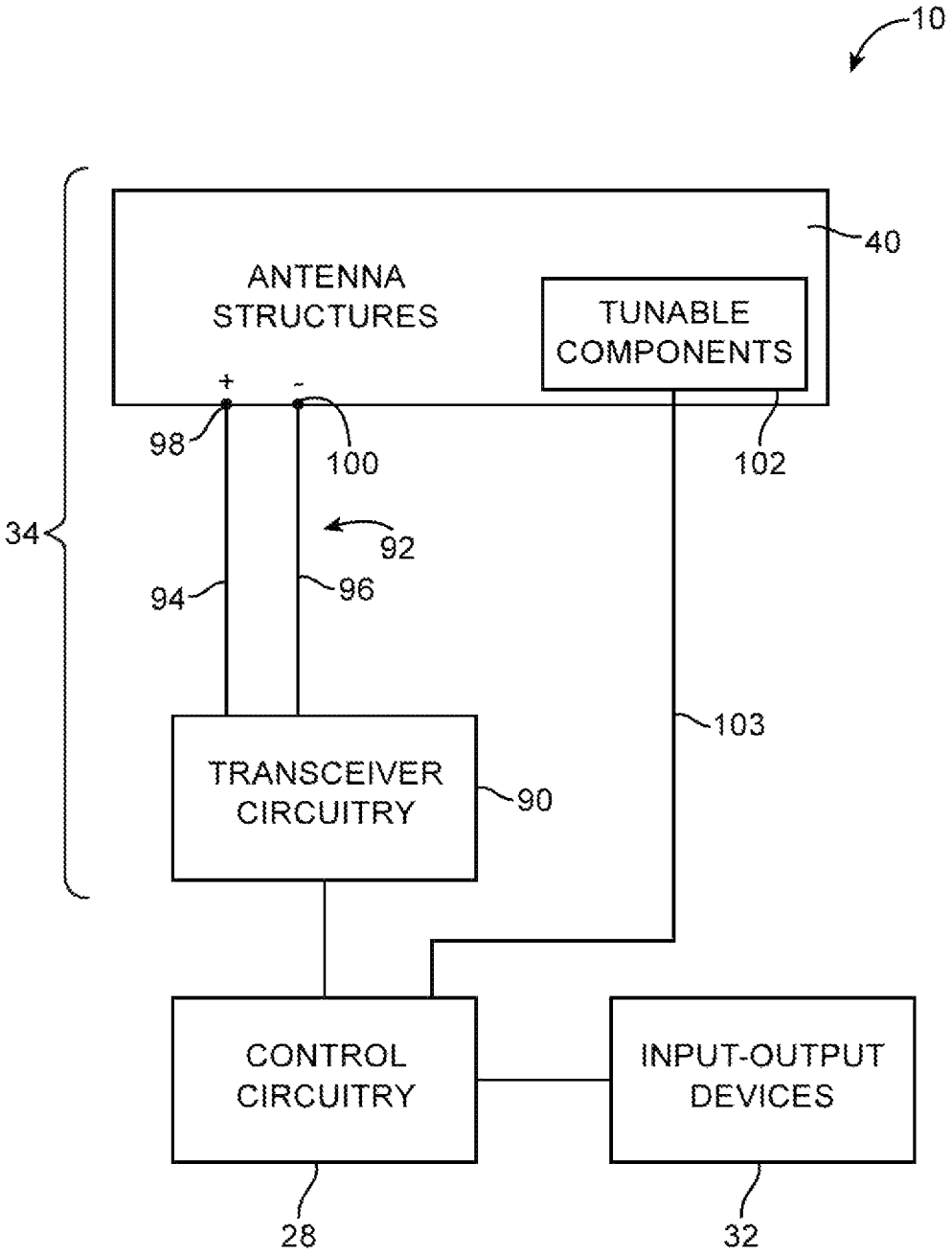
FIG. 6 is a schematic diagram of illustrative wireless circuitry in accordance with an embodiment.

As shown in FIG. 6, transceiver circuitry 90 in wireless circuitry 34 may be coupled to antenna structures 40 using paths such as path 92. Wireless circuitry 34 may be coupled to control circuitry 28. Control circuitry 28 may be coupled to input-output devices 32. Input-output devices 32 may supply output from device 10 and may receive input from sources that are external to device 10.

To provide antenna structures 40 with the ability to cover communications frequencies of interest, antenna structures 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna structures 40 may be provided with adjustable circuits such as tunable components 102 to tune antennas over communications bands of interest. Tunable components 102 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures.

During operation of device 10, control circuitry 28 may issue control signals on one or more paths such as path 103 that adjust inductance values, capacitance values, or other parameters associated with tunable components 102, thereby tuning antenna structures 40 to cover desired communications bands.

Path 92 may include one or more transmission lines. As an example, signal path 92 of FIG. 6 may be a transmission line having a positive signal conductor such as line 94 and a ground signal conductor such as line 96. Lines 94 and 96 may form parts of a coaxial cable or a microstrip transmission line (as examples). A matching network formed from components such as inductors, resistors, and capacitors may be used in matching the impedance of antenna structures 40 to the impedance of transmission line 92. Matching network components may be provided as discrete components (e.g., surface mount technology components) or may be formed from housing structures, printed circuit board structures, traces on plastic supports, etc. Components such as these may also be used in forming filter circuitry in antenna structures 40.

Transmission line 92 may be directly coupled to an antenna resonating element and ground for antenna 40 or may be coupled to near-field-coupled antenna feed structures that are used in indirectly feeding a resonating element for antenna 40. As an example, antenna structures 40 may form an inverted-F antenna, a slot antenna, a hybrid inverted-F slot antenna or other antenna having an antenna feed with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 92. As another example, antenna structures 40 may include an antenna resonating element such as a slot antenna resonating element or other element that is indirectly fed using near-field coupling. In a near-field coupling arrangement, transmission line 92 is coupled to a near-field-coupled antenna feed structure that is used to indirectly feed antenna structures such as an antenna slot or other element through near-field electromagnetic coupling.

Antennas 40 may include hybrid antennas formed both from inverted-F antenna structures (e.g., planar inverted-F antenna structures) and slot antenna structures.

Figure 7:
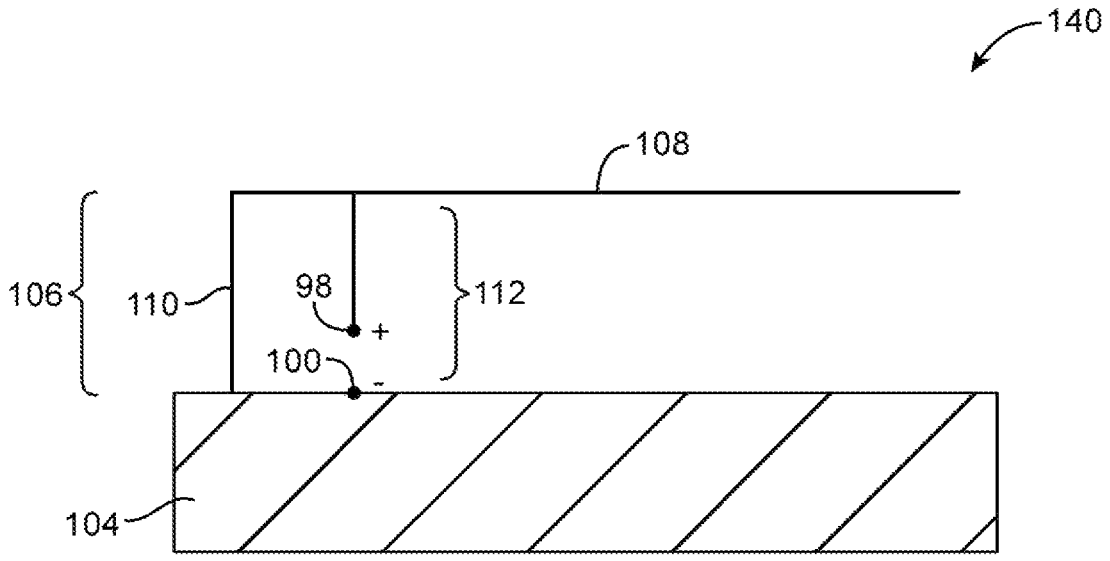
FIG. 7 is a diagram of an illustrative inverted-F antenna structure in accordance with an embodiment.

An illustrative inverted-F antenna structure is shown in FIG. 7. Inverted-F antenna structure 140 of FIG. 7 has antenna resonating element 106 and antenna ground (ground plane) 104. Antenna resonating element 106 may have a main resonating element arm such as arm 108. The length of arm 108 may be selected so that antenna structure 140 resonates at desired operating frequencies. For example, if the length of arm 108 may be a quarter of a wavelength at a desired operating frequency for antenna 40. Antenna structure 140 may also exhibit resonances at harmonic frequencies.

Main resonating element arm 108 may be coupled to ground 104 by return path 110. Antenna feed 112 may include positive antenna feed terminal 98 and ground antenna feed terminal 100 and may run in parallel to return path 110 between arm 108 and ground 104. If desired, inverted-F antenna structures such as illustrative antenna structure 140 of FIG. 7 may have more than one resonating arm branch (e.g., to create multiple frequency resonances to support operations in multiple communications bands) or may have other antenna structures (e.g., parasitic antenna resonating elements, tunable components to support antenna tuning, etc.). A planar inverted-F antenna (PIFA) may be formed by implementing arm 108 using planar structures (e.g., a planar metal structure such as a metal patch or strip of metal that extends into the page of FIG. 7).

Figure 8:
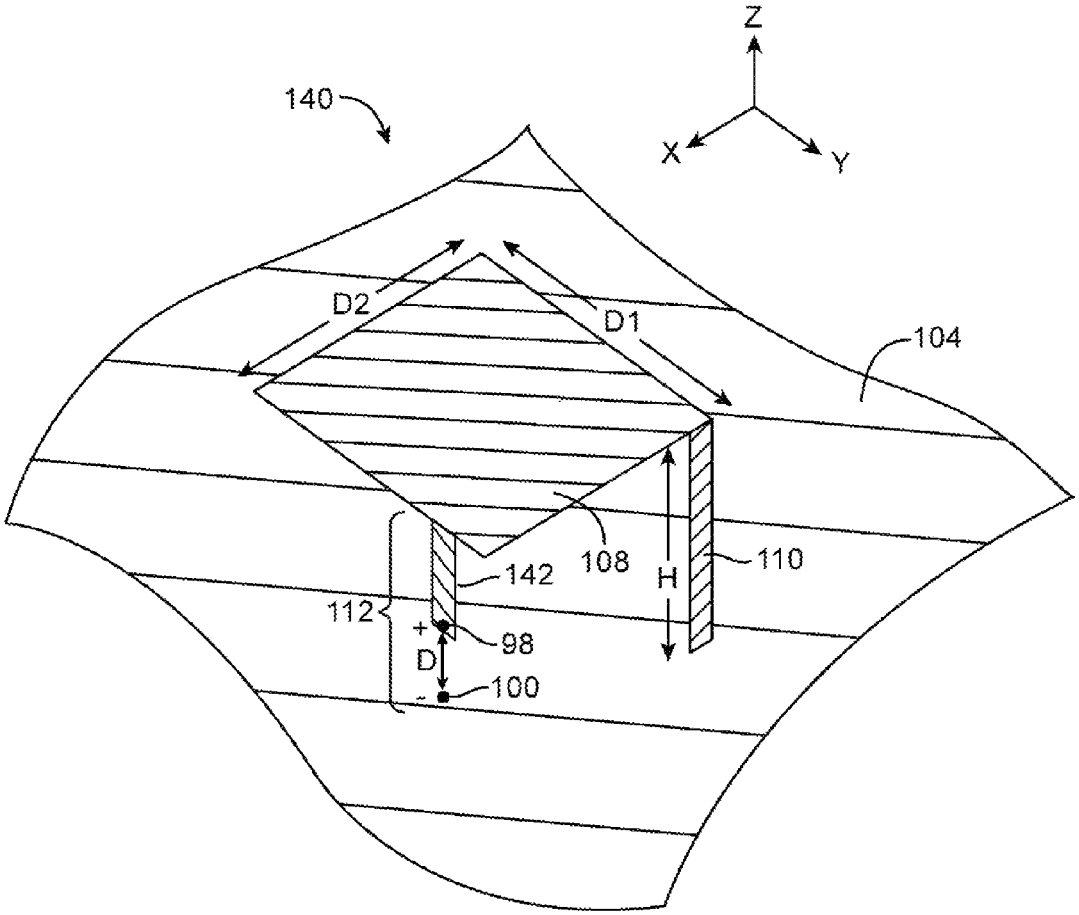
FIG. 8 is a perspective view of an illustrative planar inverted-F antenna structure in accordance with an embodiment.

FIG. 8 is a perspective view of an illustrative planar inverted-F antenna structure. As shown in FIG. 8, planar inverted-F antenna structures 140 have an antenna feed such as feed 112 that includes a downwardly protruding feed leg such as leg 142. Positive antenna feed terminal 98 may be coupled to leg 142. Ground antenna feed terminal 100 may be coupled to ground 104 and may be separated from terminal 98 by distance D. Return path (short circuit path) 100 is formed from leg 110 and couples planar resonating element "arm" structure 108 (e.g., a metal patch) to ground plane 104. Structure 108 is preferably planar and lies in a plane that is parallel to the plane of ground 104. Structure 108 may have a rectangular plate (patch) shape with lateral dimensions D1 and D2 (as an example). Configurations in which structure 108 has a meandering arm shape, shapes with multiple branches, or other shapes may also be used for planar inverted-F antenna structures 140. Planar inverted-F antenna structures such as structures 140 of FIG. 8 may be used in a hybrid planar inverted-F slot antenna.

Figure 9:
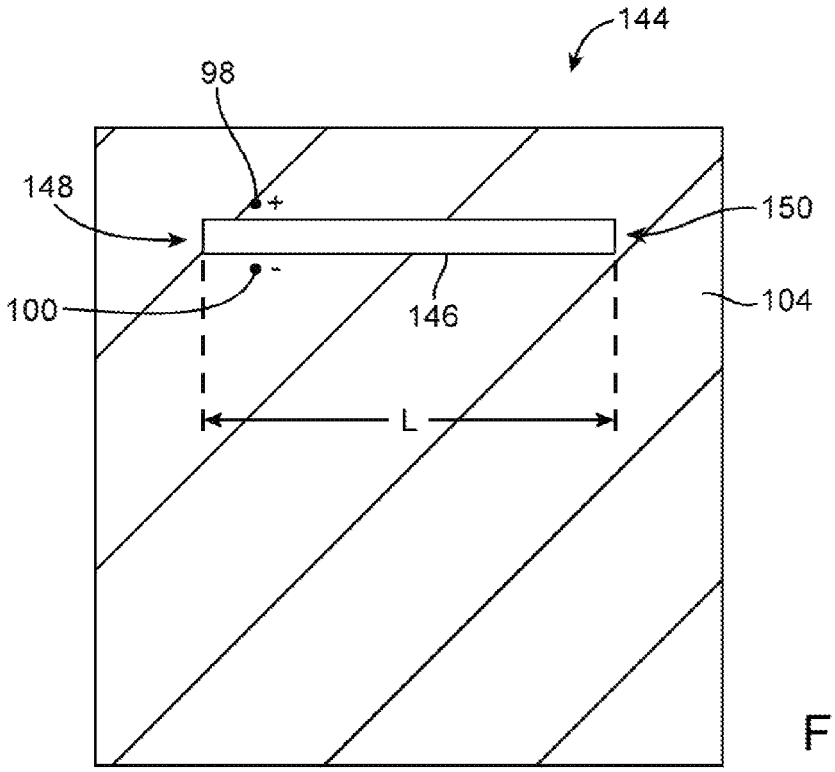
FIG. 9 is a top view of an illustrative closed slot antenna structure in accordance with an embodiment.
Figure 10:
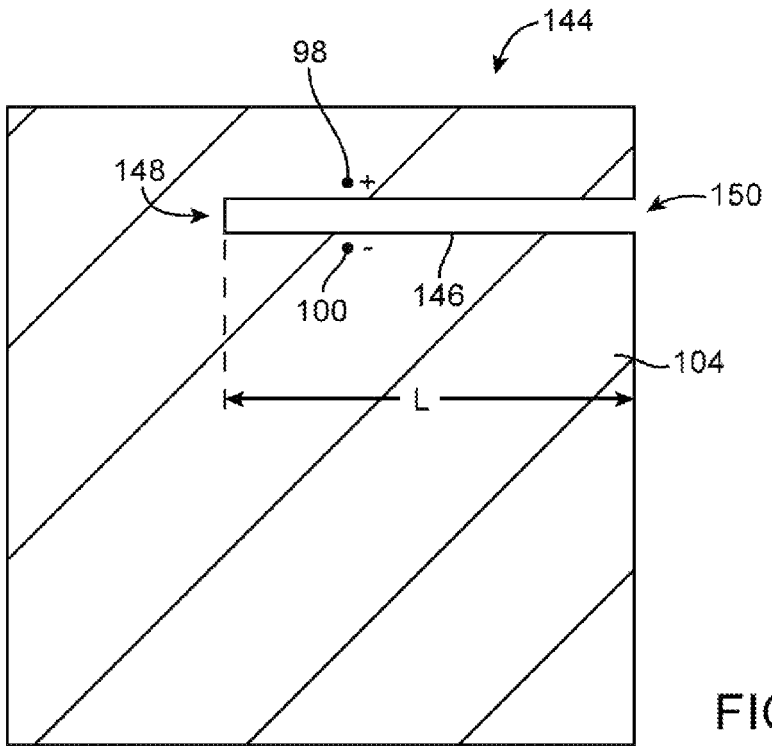
FIG. 10 is a top view of an illustrative open slot antenna structure in accordance with an embodiment.

Illustrative slot antenna structures of the type that may be used in forming antennas 40 in device 10 are shown in FIGS. 9 and 10.

Slot antenna structures 144 of FIG. 9 have a closed slot. As shown in FIG. 9, slot 146 is formed from an opening in ground plane 104 and is bridged by antenna feed terminals 98 and 100. Slot 146 has an elongated shape (e.g., a rectangular shape) with respective ends 148 and 150. End 148 of slot 146 is surrounded by portions of ground plane 104 (e.g., end 148 of slot 146 is enclosed by metal). End 150 of slot 146 is also surrounded by portions of ground plane 104. Because both ends of slot 146 are enclosed by metal, slot 146 is surrounded by metal in ground plane 104. Slots such as illustrative slot 146 of FIG. 9 that have two closed ends are sometimes referred to as closed slots (i.e., antenna structures 144 are closed slot antenna structures). Slot 146 may be filled with air, plastic, and/or other dielectric and may have one or more bends.

Slot antenna structures 144 of FIG. 10 have an open slot. As shown in FIG. 10, slot 146 is formed from an opening in ground plane 104 and is bridged by antenna feed terminals 98 and 100. Slot 146 of FIG. 10 may be filled with air, plastic, and/or other dielectric and may have one or more bends.

Slot 146 of FIG. 10 has an elongated shape (e.g., a rectangular shape) with respective ends 148 and 150. End 148 of slot 146 is surrounded by portions of ground plane 104 (e.g., end 148 of slot 146 is enclosed by metal) and is therefore sometimes referred to as forming a closed slot end. End 150 of slot 146 is not surrounded by portions of ground plane 104, but rather is open to surrounding air and/or other dielectric. Ends such as end 150 may sometimes be referred to as open slot ends. Slots such as slot 146 that have one closed end (end 148) and one open end (end 150) are sometimes referred to as open slots (i.e., slot antenna structures 144 of FIG. 10 are open slot antenna structures). The length of an open slot antenna may be about half of the length of a closed slot antenna when being configured to operate at a given frequency, so open slot antennas may sometimes be preferred in compact electronic devices or devices in which it is otherwise desirable to minimize slot length.

If desired, slots 146 for antenna structures 144 may have other shapes. For example, slots 146 may have a shapes with a single bend, shapes with one or more bends, shapes with two or more bends, shapes with locally widened portions, etc. Slots 146 of FIGS. 9 and 10 are merely illustrative. Ground plane 104 of slot antenna structures 140 may be formed from metal traces on a printed circuit or plastic carrier, metal traces on other substrates, metal that forms part of an external housing wall or other portion of a metal housing (see, e.g., housing 12, which may have a planar rear wall portion and vertically extending sidewall portions), metal that forms part of an electronic device, part of an internal housing structure, part of a metal bracket or other internal support structure, or other conductive structures in device 10. Slots 146 may be filled with plastic (e.g., to prevent intrusion of dust and other substances into the interior of device 10 in a configuration in which slots 146 are formed in a metal housing such as housing 12 for device 10). Some or all of slots 146 may also be filled with other dielectric materials (e.g., air, glass, ceramic, etc.).

The performance of planar inverted-F antenna (PIFA) structures 140 of FIG. 8 may be adjusted by adjusting the shape of resonating element 108 (e.g., by adjusting lateral dimensions D1 and/or D2 or other attributes of resonating element 108). The performance of slot antenna structures 144 may be adjusted by adjusting the size of slot 146 (e.g., by adjusting the perimeter of the slot). In narrow slots, for example, the resonance of a slot antenna structure will be influenced by adjustment of longitudinal dimension (length L) of slot 146, because the perimeter of a narrow slot is about equal to twice its length.

Figure 11:
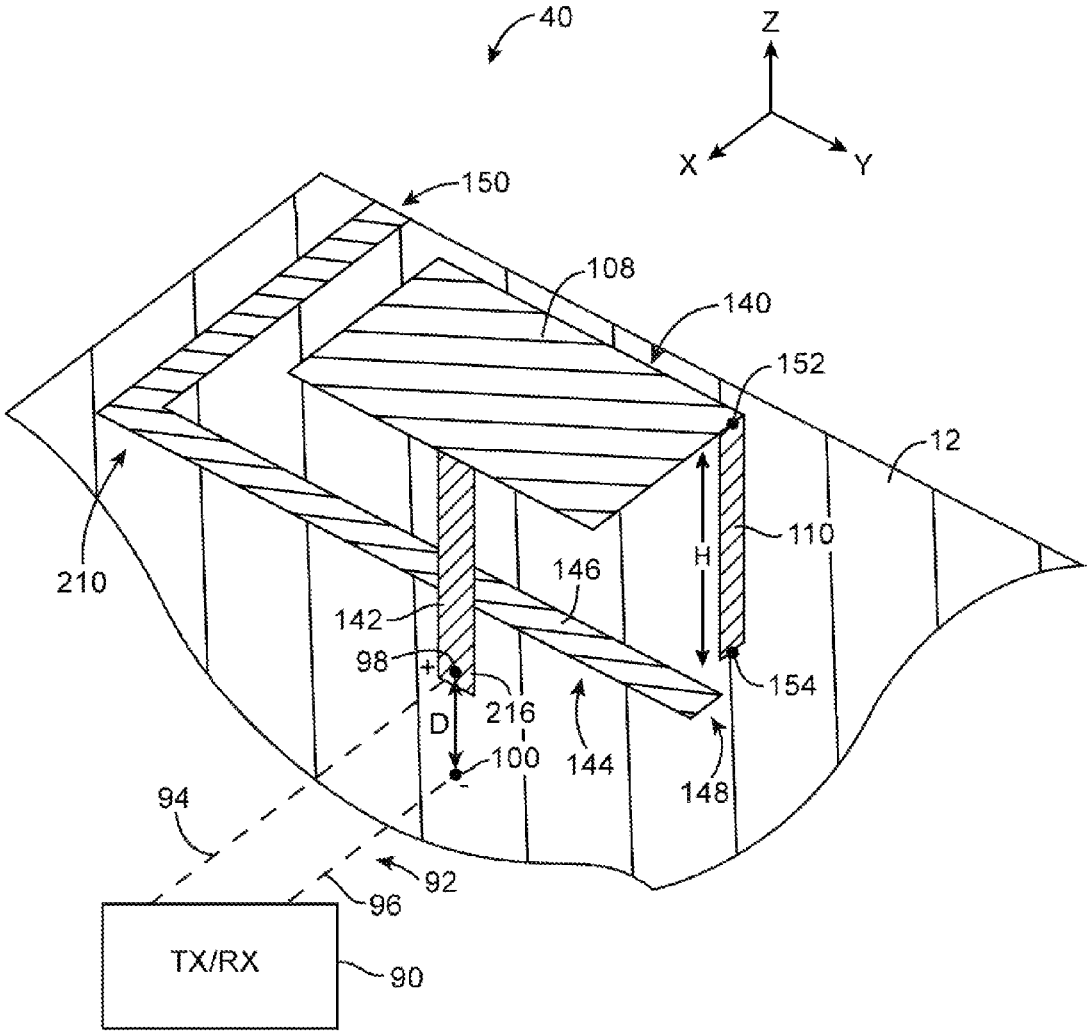
FIG. 11 is a perspective view of an illustrative hybrid planar inverted-F slot antenna in accordance with an embodiment.

Antenna(s) 40 of device 10 may be formed using hybrid planar inverted-F slot antenna(s). An illustrative hybrid PIFA slot antenna is shown in FIG. 11. Hybrid antenna 40 of FIG. 11 is formed from both slot antenna structures 144 and planar inverted-F antenna structures 140.

Illustrative hybrid planar inverted-F slot antenna 40 of FIG. 11 has an antenna ground (ground 104 of FIGS. 8, 9, and 10) that has been formed from metal housing 12. Metal traces and/or other conductive structures may also be used in forming an antenna ground for hybrid antenna 40. The configuration of FIG. 11 in which metal electronic device housing 12 forms an antenna ground is merely illustrative. A ground plane may also be formed using metal traces on printed circuits, etc.

Slot 146 of FIG. 11 may be formed in ground plane 12. Slot 146 may be filled with plastic or other dielectric. In the example of FIG. 11, slot 146 has an open end such as end 150 and an opposing closed end such as closed end 148. If desired, slot 146 may be a closed slot. Slot 146 has bend 210. If desired, slot 146 may be provided with two bends, three or more bends, etc. The example of FIG. 11 is merely illustrative.

In addition to slot antenna structures 144 formed from slot 146, antenna 40 has planar inverted-F antenna structures 140. Planar inverted-F antenna structures 140 may include resonating element structure 108 (e.g., a patch of metal). Patch 108 may have portions that protrude downwardly towards ground 12 such as leg 142 and leg 110. Leg 142 may form part the feed for antenna 40. Tip 216 of leg 142 is separated from ground plane 12 by a dielectric gap such as air gap D (i.e., tip 216 is not directly connected to ground 12). Return path 110 is coupled to patch 108 at connection point 152 and is connected to ground 12 at connection point 154.

Transceiver circuitry 90 is coupled to antenna feed terminals such as terminals 98 and 100 by transmission line 92.

Terminal 98 may be connected to tip portion 216 of leg 142. Terminal 100 may be connected to ground structure 12. Positive signal line 94 may be coupled to terminal 98. Ground signal line 96 may be coupled to terminal 100.

Planar inverted-F antenna structures 140 are directly fed by the transmission line coupled to terminals 98 and 100. Through near-field electromagnetic coupling and/or by providing antenna feed signals across slot 146 through structures 140, planar inverted-F antenna structures 140 are coupled to slot antenna structures 146. As a result, both slot antenna structures 145 and planar inverted-F antenna structures 140 contribute to the overall performance of hybrid antenna 40.

Figure 12:
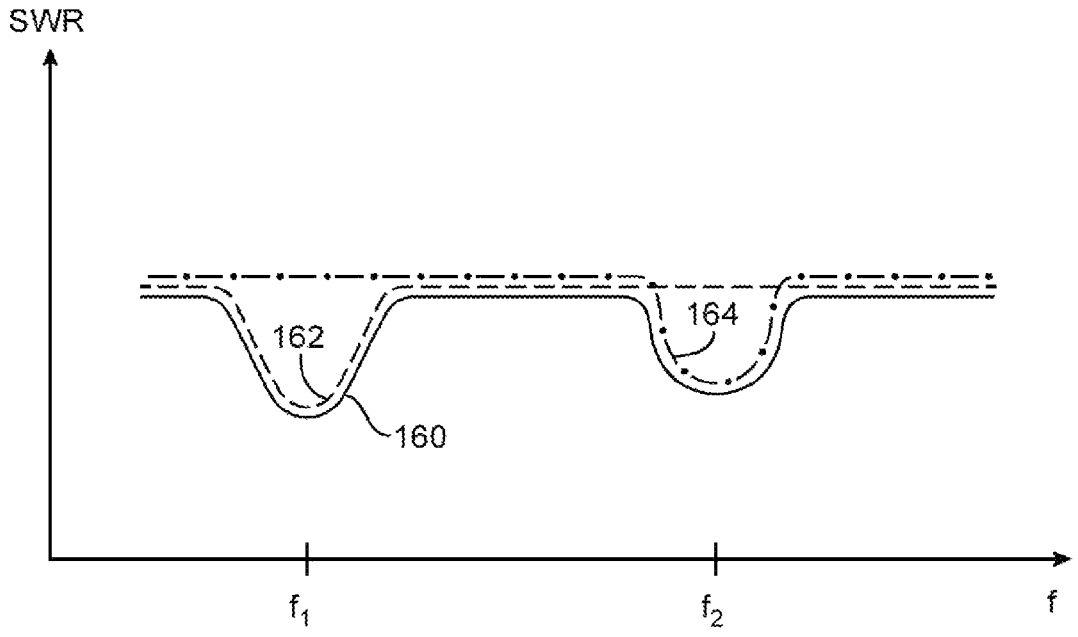
FIG. 12 is a graph in which antenna performance (standing wave ratio) has been plotted against operating frequency for an illustrative hybrid planar inverted-F slot antenna in accordance with an embodiment.

FIG. 12 is a graph in which antenna performance (standing-wave ratio SWR) for the antenna structures of FIG. 11 has been plotted as a function of antenna signal operating frequency f. Curve 164 corresponds to the response of planar inverted-F antenna structures 140. Curve 164 may exhibit an antenna resonance at frequency f2. The position of the resonance at frequency f2 may be adjusted by adjusting the lateral dimensions of patch 108 (as an example). Curve 162 corresponds to the response of slot antenna structures 144. Curve 162 may exhibit an antenna resonance at frequency f1. The position of the resonance at frequency f1 may be adjusted by adjusting the length of slot 146 in slot antenna structures 144. The overall performance of antenna structures 40 is given by curve 160. As shown in FIG. 12, curve 160 reflects contributions from both slot antenna structures 144 and from planar inverted-F antenna structures 140. Curve 160 may, for example, have a first resonance at f1 that is influenced by the characteristics of slot antenna structures 144 and may have a second resonance at f2 that is influenced by the characteristics of planar inverted-F antenna structures 140.

The use of the hybrid antenna arrangement for antenna 40 allows the advantages of the planar inverted-F antenna portion of antenna 40 to be exploited at frequency f2 (i.e., the ability of planar inverted-F antenna structures 140 to exhibit good antenna efficiency and high bandwidth at frequency f2), while allowing the advantages of the slot antenna portion of antenna 40 to be exploited at frequency f1 (i.e., the ability of slot antenna structures 144 to exhibit good antenna efficiency and bandwidth at frequency f1).

With one suitable arrangement, antenna 40 may be a dual band antenna for wireless local area network signals (e.g., IEEE 802.11 signals), frequency f2 may be 5 GHz, and frequency f1 may be 2.4 GHz. In this type of arrangement, PIFA structures 140 may be efficient at 5 GHz, but may not be as efficient at 2.4 GHz, particularly in configurations in which vertical height H of patch 108 above ground plane 12 is limited (e.g., in compact devices where available antenna height is constrained), whereas slot antenna structures 146 may be efficient at 2.4 GHz. The complementary nature of hybrid antenna 40 allows the positive attributes of each type of antenna to be used, thereby ensuring that both the low band (f1) and high band (f2) ranges are effectively covered by antenna 40.

Figure 13:
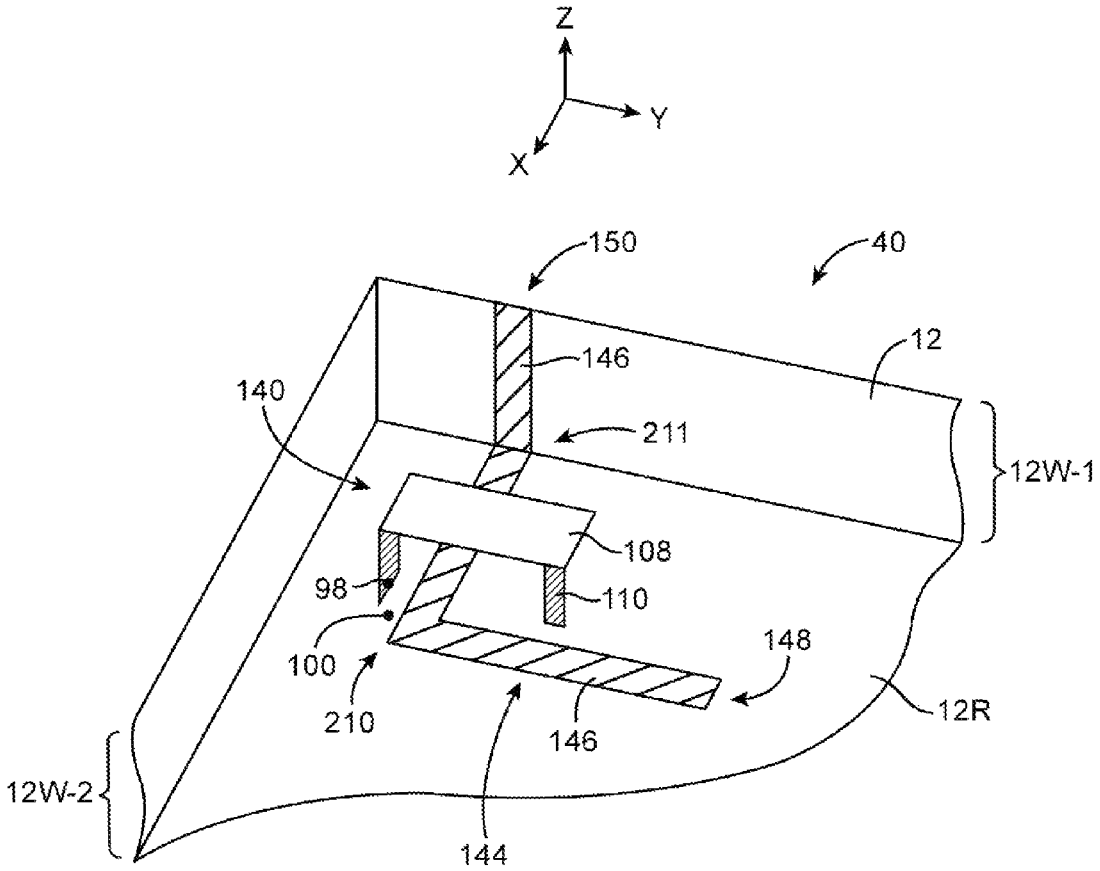
FIG. 13 is a perspective view of another illustrative hybrid planar inverted-F slot antenna in accordance with an embodiment.

Another illustrative arrangement for hybrid antenna 40 is shown in FIG. 13. As shown in FIG. 13, housing 12 may have planar rear wall portion 12R and sidewalls such as vertical sidewalls 12W-1 and 12W-2. Sidewalls 12W-1 and 12W-2 may be flat or curved. Slot 146 may extend away from planar rear wall 12R and up a sidewall such as sidewall 12W-1 in dimension Z. Slot 146 may have two bends such as bends 211 and 210 or may have other shapes. Antenna feed terminals 98 and 100 may be formed on the edge of slot 146 nearest sidewall 12W-1 and return path 110 may be formed on the opposing edge of slot 146.

Antennas such as hybrid antenna 40 may be used in an array of two or more antennas. For example, a first antenna such as antenna 40 of FIG. 13 may be formed along one portion of an edge of device 10 and a second antenna such as antenna 40 of FIG. 13 may be formed along a second portion of the edge of device 10. The antennas may be used in a multiple-input-multiple output (MIMO) array or other array (e.g., for wireless local area networking or other wireless communications). If desired, device 10 may contain one or more antennas such as antenna 40 (e.g., for wireless local area network communications) and one or more cellular telephone antennas, satellite navigation system antennas, etc.

Figure 14:
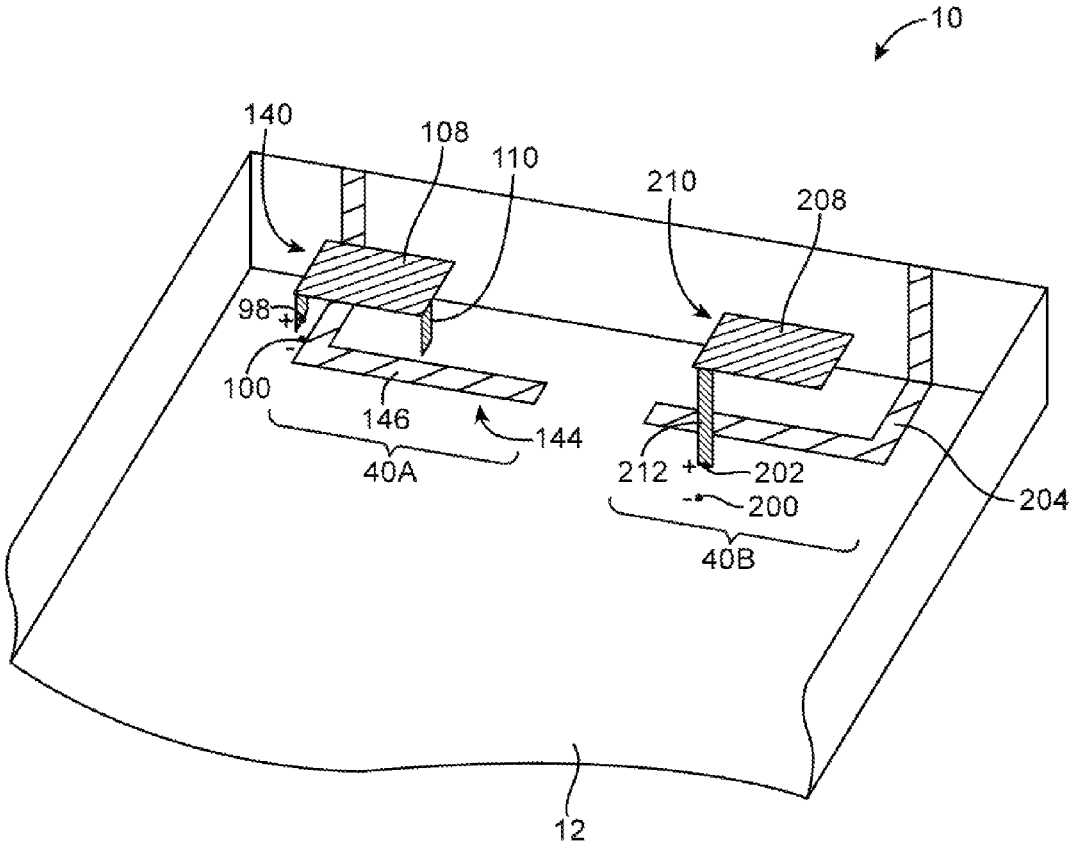
FIG. 14 is a perspective view of a portion of an electronic device with multiple antennas in accordance with an embodiment.

As an example, device 10 of FIG. 14 has first antenna 40A and second antenna 40B. Antenna 40A may be a hybrid planar inverted-F slot antenna (see, e.g., antenna 40 of FIG. 13). Antenna 40A may have planar inverted-F antenna structures 140 formed from patch resonating element 108, return path 110, and feed terminals 98 and 100. Antenna 40A may also have slot antenna structures 144 formed from slot 146 in ground plane 12 (e.g., a metal housing for device 10). Antenna 40A may be used for wireless local area network communications. For example, antenna 40A may be a dual band antenna covering signals at a low band of 2.4 GHz and a high band at 5 GHz.

Antenna 40B may be an indirectly fed cellular telephone antenna. Antenna 40B may be a slot antenna having a slot such as slot 204 in a ground formed from metal housing 12 or other metal structures. Antenna 40B may be fed using a near-field coupled feed structure such as structure 210. Structure 210 may, as an example, have a patch such as metal patch 208. A transmission line may have a positive signal line coupled to positive feed terminal 202 on leg 212 of feed structure 210 and may have a ground line coupled to ground feed terminal 200 on ground 12. The transmission line may convey signals for antenna 40B to feed structure 210. Feed structure 210 may be electromagnetically coupled to slot 204 through near field electromagnetic coupling (i.e., structure 210 may indirectly feed a slot antenna formed from slot 204). Slot 204 may be an open slot (as an example). Antenna 40B may be used in handling cellular telephone signals at frequencies of 700-2700 MHz or other suitable frequencies.

Figure 15:
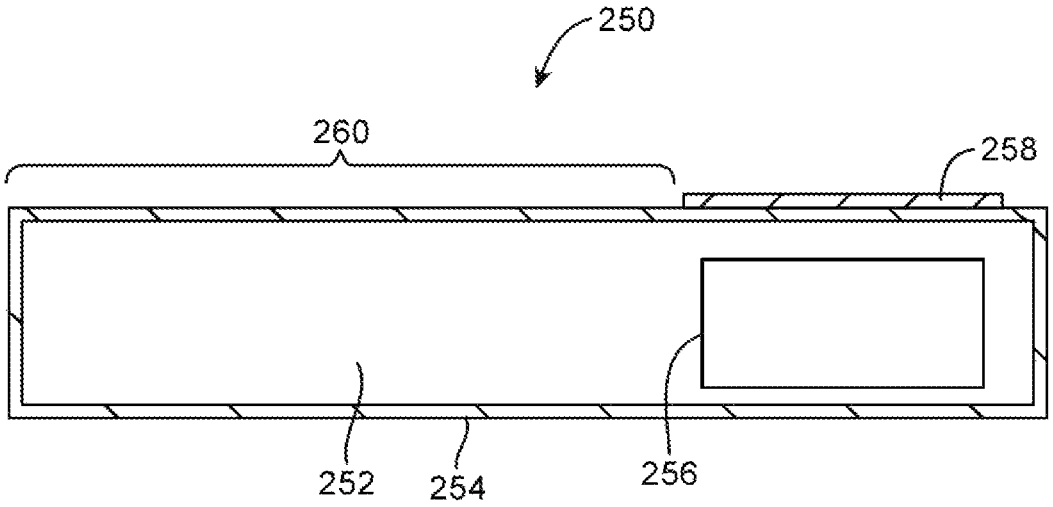
FIG. 15 is a cross-sectional side view of an illustrative speaker box in accordance with an embodiment.

If desired, antenna structures for antenna 40 may be supported using a plastic support structure. The plastic support structure may also serve as a speaker cavity (sometimes referred to as a speaker box). A cross-sectional side view of an illustrative speaker box for device 10 is shown in FIG. 15. As shown in FIG. 15, speaker box 250 may have speaker box cavity 252 formed within speaker box wall structure 254. Wall structure 254 may be a hollow plastic box and may have an acoustic port covered with mesh to prevent the intrusion of dust and moisture while allowing sound to escape from air-filled cavity 252 within the box. Speaker driver 256 may be located within cavity 252. Optional metal structure 258 may be incorporated into box 250 (e.g., to allow the thickness of wall 254 to be thinned). Metal structure 258 may, for example, be located over driver 256.

Figure 16:
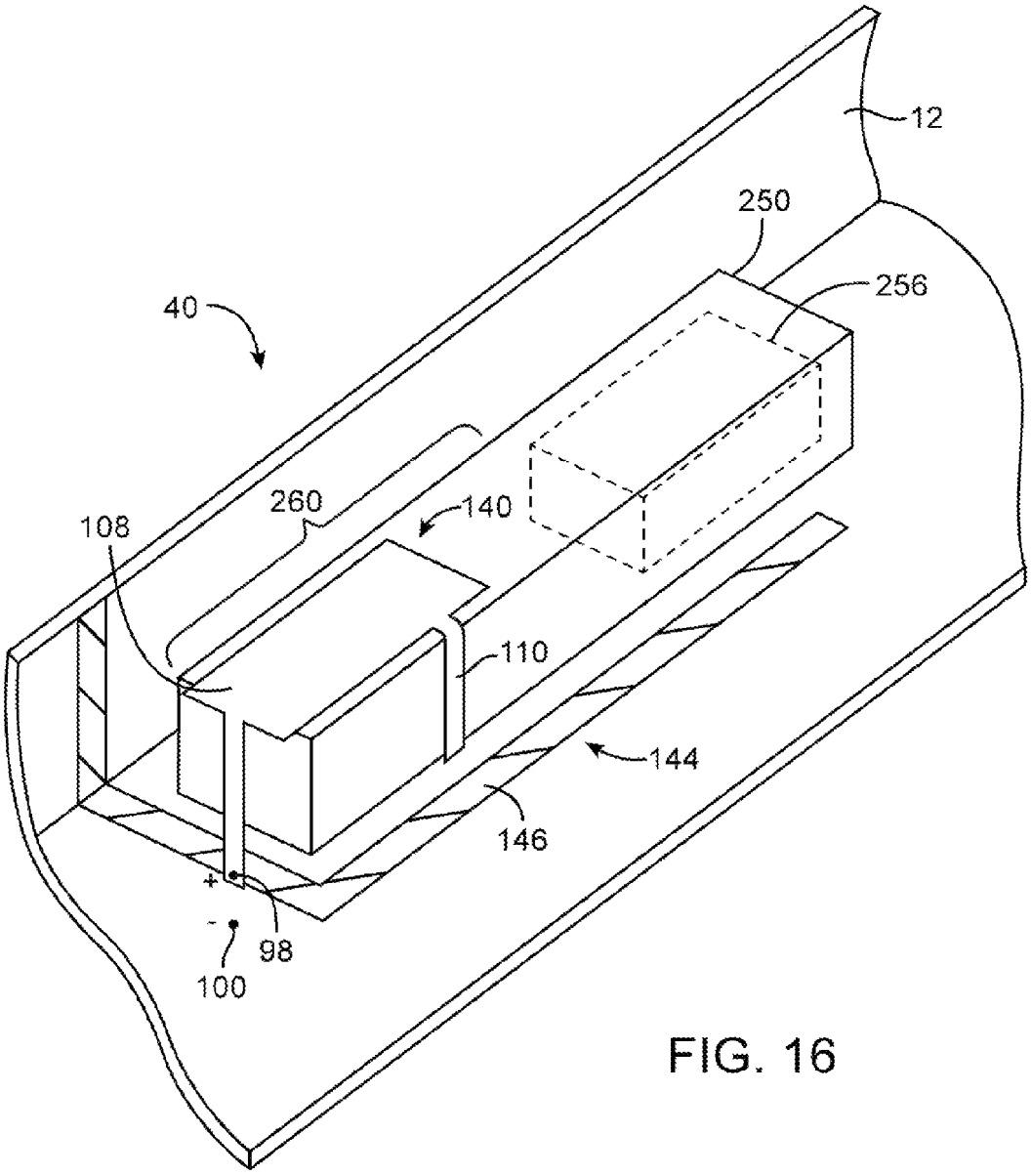
FIG. 16 is a perspective view of an illustrative end portion of an electronic device in which antenna structures for a hybrid antenna are being supported by a speaker box of the type shown in FIG. 15 in accordance with an embodiment.

Antenna structures can be supported by speaker box 250. As shown in FIG. 16, for example, patch antenna resonating element 108 of planar inverted-F antenna structures 140 in antenna 40 may be supported by box 250 (e.g., in a portion of box 250 such as region 260 that does not overlap driver 256). Box 250 may run parallel to at least some of the portions of slot 146 in slot antenna structures 144. For example, box 250 may have an elongated shape that extends parallel to the edge of housing 12.

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a housing having a metal wall;

a hybrid planar inverted-F slot antenna, wherein the hybrid planar inverted-F slot antenna has slot antenna structures formed from a slot in the metal wall and has planar inverted-F antenna structures, the planar inverted-F antenna structures include a ground feed terminal, a positive feed terminal, and a return path leg, the return path leg and the ground feed terminal are coupled to the metal wall on first and second opposing sides of the slot respectively, the positive feed terminal is coupled to the planar inverted-F antenna structures at the second side of the slot, and the positive feed terminal is separated from the metal wall of the housing by a gap;

an indirectly fed slot antenna; and transceiver circuitry coupled to both the hybrid planar inverted-F slot antenna and the indirectly fed slot antenna.

2. The electronic device defined in claim 1 wherein the planar inverted-F antenna structures include a resonating element formed from a metal patch.

3. The electronic device defined in claim 2 further comprising a plastic structure that supports the metal patch.

4. The electronic device defined in claim 3 wherein the plastic structure forms plastic walls for a speaker box.

5. The electronic device defined in claim 1 wherein the slot has at least one bend.

6. The electronic device defined in claim 1 wherein the metal wall has a planar rear wall portion and sidewall portions and the slot is an open slot formed at least partly in the planar rear wall portion and at least partly in the sidewall portions.

7. The electronic device defined in claim 6 further comprising plastic that fills the slot.

8. A hybrid planar inverted-F slot antenna, comprising:

slot antenna structures formed from a slot in a metal electronic device housing wall;

planar inverted-F antenna structures formed from a metal resonating element, the metal resonating element comprising a feed leg and a return path leg; and a speaker box that supports the metal resonating element, the return path leg and the feed leg being formed on different sides of the speaker box.

9. The hybrid planar inverted-F slot antenna defined in claim 8 wherein the metal electronic device housing wall includes a planar wall portion and wherein the metal resonating element lies in a plane that is parallel to the planar wall portion.

10. The hybrid planar inverted-F slot antenna defined in claim 9 wherein the slot has at least one bend and has a portion that extends along at least one sidewall portion of the metal electronic device housing wall.

11. The hybrid planar inverted-F slot antenna defined in claim 8 wherein the slot antenna structures are configured to exhibit an antenna resonance at 2.4 GHz and the planar inverted-F antenna structures are configured to exhibit an antenna resonance at 5 GHz.

12. An electronic device, comprising:

a hybrid planar inverted-F slot antenna having slot antenna structures formed from a slot in a metal electronic device housing wall and having planar inverted-F antenna structures formed from a metal resonating element and a feed leg that is coupled to the metal resonating element and separated from the metal electronic device housing wall by a gap; and an indirectly fed slot antenna that is indirectly fed using a metal patch structure that is separate from the metal resonating element.

13. The electronic device defined in claim 12 wherein the hybrid planar inverted-F slot antenna comprises a dual band wireless local area network antenna.

14. The electronic device defined in claim 13 wherein the indirectly fed slot antenna comprises a cellular telephone antenna having a slot formed in the metal electronic device housing wall.

15. The electronic device defined in claim 1 wherein the planar inverted-F antenna structures include a planar resonating element formed above the slot antenna structures.

16. The electronic device defined in claim 12, further comprising:

a display cover layer, wherein the metal electronic device housing wall comprises a rear housing wall that opposes the display cover layer, the slot comprises a first portion formed in the rear housing wall and a second portion formed in a metal electronic device housing side wall, the second portion extends from the first portion to an edge of the metal electronic device housing side wall, the indirectly fed slot antenna comprises an additional slot having a third portion that is formed in the rear housing wall and a fourth portion that is formed in the metal electronic device housing side wall, and the fourth portion extends from the third portion of the additional slot to the edge of the metal electronic device housing side wall.

17. The electronic device defined in claim 16, wherein the first portion of the slot comprises a perpendicular bend and a closed end that is surrounded on three sides by the rear housing wall, the third portion of the additional slot comprises a perpendicular bend and a closed end that is surrounded on three sides by the rear housing wall, and the closed end of the first portion of the slot is interposed between the perpendicular bend of the first portion of the slot and the closed end of the third portion of the additional slot.

18. The electronic device defined in claim 5, wherein the at least one bend separates the slot into first and second substantially perpendicular portions.

19. The hybrid inverted-F slot antenna defined in claim 8, wherein the return path leg is coupled to the metal electronic device housing wall on a first side of the slot and the feed leg is provided directly over a second side of the slot separated from the first side of the slot by the slot.

20. The electronic device defined in claim 12, wherein the planar inverted-F antenna structures are further formed from a return path leg coupled to the metal resonating element and the metal electronic device housing wall, the slot comprises a portion that extends to an edge of the metal electronic device housing wall, and the feed leg and the return path are disposed over opposing sides of the portion of the slot.

* * * * *